US008154379B2

(12) United States Patent
Theissl et al.

(10) Patent No.: US 8,154,379 B2
(45) Date of Patent: Apr. 10, 2012

(54) ELECTRICAL PTC THERMISTOR COMPONENT, AND METHOD FOR THE PRODUCTION THEREOF

(75) Inventors: Udo Theissl, Graz (AT); Andreas Webhofer, Dellach (AT)

(73) Assignee: EPCOS AG, Munich (DE)

( * ) Notice: Subject to any disclaimer, the term of this patent is extended or adjusted under 35 U.S.C. 154(b) by 496 days.

(21) Appl. No.: 12/297,579

(22) PCT Filed: Apr. 18, 2007

(86) PCT No.: PCT/DE2007/000696

§ 371 (c)(1),
(2), (4) Date: Feb. 12, 2009

(87) PCT Pub. No.: WO2007/118472

PCT Pub. Date: Oct. 25, 2007

(65) Prior Publication Data

US 2009/0167481 A1 Jul. 2, 2009

(30) Foreign Application Priority Data

Apr. 18, 2006 (DE) ..... 10 2006 017 796

(51) Int. Cl.
*H01C 7/10* (2006.01)

(52) U.S. Cl. ..... 338/22 R; 338/307; 338/327; 438/238; 438/382

(58) Field of Classification Search ..... 338/22 R, 338/332–334, 327, 307–309; 438/54–55, 438/238, 99, 382

See application file for complete search history.

(56) References Cited

U.S. PATENT DOCUMENTS

| | | | | |
|---|---|---|---|---|
| 3,027,529 | A | 3/1962 | Schofer et al. | |
| 5,075,665 | A | 12/1991 | Taira et al. | |
| 5,115,221 | A | 5/1992 | Cowman | |
| 5,245,309 | A | 9/1993 | Kawase et al. | |
| 5,289,155 | A * | 2/1994 | Okumura et al. | 338/22 SD |
| 5,337,038 | A * | 8/1994 | Taniguchi et al. | 338/22 R |
| 5,537,286 | A | 7/1996 | Gozlan et al. | |
| 5,866,196 | A * | 2/1999 | Ueno et al. | 427/79 |
| 6,320,738 | B1 | 11/2001 | Yamana et al. | |
| 6,400,253 | B1 * | 6/2002 | Jinno et al. | 338/332 |
| 6,515,572 | B2 | 2/2003 | Groen et al. | |
| 6,627,120 | B2 | 9/2003 | Shimizu | |
| 6,984,543 | B2 * | 1/2006 | Mihara et al. | 438/55 |
| 2002/0109575 | A1 | 8/2002 | Jeong et al. | |

(Continued)

FOREIGN PATENT DOCUMENTS

DE 1 415 409 12/1970

(Continued)

OTHER PUBLICATIONS

Machine Translation of JP05-308003 (Kubota).

(Continued)

*Primary Examiner* — Kyung Lee
(74) *Attorney, Agent, or Firm* — Fish & Richardson P.C.

(57) ABSTRACT

An electrical PTC thermistor component includes a base that includes a peripheral surface, first and second faces on different sides of the component, and first and second conductive layers, each of which is on at least one of the first and second faces. The first conductive layer is not on the peripheral surface. The second conductive layer includes a cap that covers, and overlaps edges of, the at least one of the first and second faces.

23 Claims, 2 Drawing Sheets

U.S. PATENT DOCUMENTS

| | | | |
|---|---|---|---|
| 2002/0180576 | A1 | 12/2002 | Kumura et al. |
| 2004/0140595 | A1 | 7/2004 | Mihara et al. |
| 2006/0132280 | A1 | 6/2006 | Kirsten |

FOREIGN PATENT DOCUMENTS

| | | |
|---|---|---|
| DE | 39 30 000 | 3/1990 |
| DE | 41 08 535 | 10/1991 |
| DE | 40 29 681 | 4/1992 |
| DE | 42 07 915 | 9/1992 |
| DE | 692 11 552 | 2/1997 |
| DE | 197 36 855 | 2/1999 |
| DE | 199 46 199 | 4/2001 |
| DE | 100 53 769 | 5/2001 |
| DE | 100 18 377 | 12/2001 |
| DE | 100 26 260 | 12/2001 |
| DE | 103 07 804 | 9/2003 |
| DE | 102 18 154 | 11/2003 |
| EP | 0 851 444 | 7/1998 |
| JP | 01-128501 | 5/1989 |
| JP | 05-029115 | 2/1993 |
| JP | 05-308003 | 11/1993 |
| JP | 07-254534 | 10/1995 |
| JP | 08-250307 | 9/1996 |
| JP | 09-055303 | 2/1997 |
| JP | 09-129417 | 5/1997 |
| JP | 10-256005 | 9/1998 |
| JP | 2001-126946 | 5/2001 |
| JP | 2003-257776 | 9/2003 |

OTHER PUBLICATIONS

Machine Translation of JP09-129417 (Kawada).

Heywang, W., "Semiconducting Barium Titanate", J. Materials Science, No. 6, (1971), pp. 1214-1223.

International Search Report in Application No. PCT/DE2007/000696, dated Jul. 30, 2007.

English Translation of the International Preliminary Report on Patentability (incl. Written Opinion) in Application No. PCT/DE2007/000696, dated Nov. 17, 2008.

* cited by examiner

ELECTRICAL PTC THERMISTOR COMPONENT, AND METHOD FOR THE PRODUCTION THEREOF

BACKGROUND

Ceramic components, as well as methods for their production, are known, e.g., from the publications DE 4029681 A1, DE 10218154 A1, and DE 4207915 A1.

SUMMARY

An electrical PTC thermistor element is specified with a base body, e.g., made from PTC ceramic. PTC stands for Positive Temperature Coefficient. The component comprises a first and a second conductive layer that are arranged on an end face of the base body. The peripheral surface of the base body is free from the first conductive layer. The second conductive layer forms a cap that covers the end face of the base body, overlapping the edges, wherein this second layer lies partially on the peripheral surface of the base body.

In one variant, a first and a second conductive layer are provided on each end face. The component has mirror symmetry.

The first conductive layer is limited to the corresponding end face of the base body. In contrast to the second conductive layer, the first conductive layer does not overlap the edges. The first layer contacts the base body. An end-face region of the second conductive layer is arranged on the first conductive layer and another region of the second conductive layer contacts the peripheral surface of the base body.

The first conductive layer is a barrier layer breaking down the depletion layer. In contrast to the first conductive layer, the second conductive layer is not provided as a barrier layer, but instead as an electrical terminal of the component. This terminal is provided for soldering, e.g., with a printed circuit board, and is suitable for surface mounting.

Thus the component can be surface mounted. The base body has a rectangular cross section, or its peripheral surface has at least one flat side surface.

Both the first and also the second conductive layer can have several sub-layers made from various materials. The bottom layer, i.e., the layer facing the base body, in each conductive layer is a bonding layer. The first conductive layer can have, e.g., a chromium-containing sub-layer as a bonding layer. A nickel-containing bonding layer is deposited onto this chromium-containing layer.

The second conductive layer can have, e.g., a silver-containing bottom sub-layer, a nickel-containing middle sub-layer, and, in particular, a tin-containing upper sub-layer that can be soldered. The bottom silver layer can be activated with a Pd activator before the nickel plating.

The lowermost sub-layer of the first conductive layer is sputtered and optionally reinforced galvanically. Additional sub-layers of the first conductive layer can be deposited, e.g., chemically or galvanically. The sub-layers of the first conductive layer, however, can also be generated by screen printing with subsequent burn-in.

The second conductive layer has at least one layer, e.g., a silver-containing layer, deposited through a dipping process. This is the lowermost layer of the second conductive layer. As mentioned above, at least one additional layer that can also be generated in a dipping process, through screen printing, or through chemical or galvanic processes can be deposited on the lowermost layer.

Furthermore, a method for producing a PTC thermistor component is specified, in which:

A) a barrier layer (first conductive layer) is deposited by sputtering on primary surfaces of a large area substrate that comprises regions provided as component regions, B) the substrate is partitioned according to component regions, wherein each partitioned component region comprises a base body, with the barrier layer being arranged on the two end faces of the base body, and C) conductive caps (second conductive layer) arranged on the end face are generated in a dipping process at the partitioned component regions.

The large area substrate is generated by pressing a ceramic-containing material with given properties and subsequent sintering. In one variant, 50% ceramic material ML151 and 50% ceramic material ML251 are homogenized with a dry or wet method. The mixture is pressed and sintered on a uniaxial dry press. The substrate is lapped—in one variant only after sintering—to a prescribed thickness, held for a given time period in a solution containing sulfuric acid to improve the bonding strength of the sputtering layer, and then washed.

For generating the barrier layer, the primary surfaces of the substrate are metalized. In one variant, a chromium-containing layer is initially deposited by sputtering. The Cr layer can be generated, e.g., in a thickness of 0.1 to 1.0 μm. Then a nickel-containing layer, e.g., with a thickness of 0.1-1.0 μm, is also deposited through sputtering and reinforced galvanically or chemically up to a thickness that advantageously exceeds 1 μm and equals, e.g., 2-10 μm. After metallization, the substrate is cut to form partitioned component regions.

Before caps are applied, the edges between the end faces and the peripheral surface of the base body are rounded or at least flattened through abrasion with the addition of water and SiC powder.

The conductive caps are deposited in a dipping process wherein each base body is dipped in a metal-containing, silver-containing paste that is burned in after the dipping, in an air atmosphere and at a temperature of max. 900° C. The metal layer generated in this way is abraded and/or polished to generate a uniform layer thickness, e.g., also with the addition of water and SiC powder.

The conductive caps are activated with Pd activator, nickel-plated, and tin-plated after polishing, advantageously in the specified sequence. The nickel plating is performed chemically, i.e., currentless. The tin plating is performed galvanically. In principle, the Pd activation can be eliminated if the nickel plating is performed galvanically.

The described method generates PTC thermistor components that are then measured, evaluated, and, while excluding defective components, taped.

Because the barrier layer is generated in a dipping process before rather than after the partitioning of the component regions, there is the advantage that the geometric dimensions—defining the electrical properties of the component—and thus also the production tolerances with respect to the electrical properties of the components can be kept small. The conductive caps indeed directly contact the base body, but they have essentially no influence on the electrical resistance of the component.

The processing steps for the production of specified components will now be explained with reference to schematic figures, not drawn to scale.

DETAILED DESCRIPTION

Figure 1:
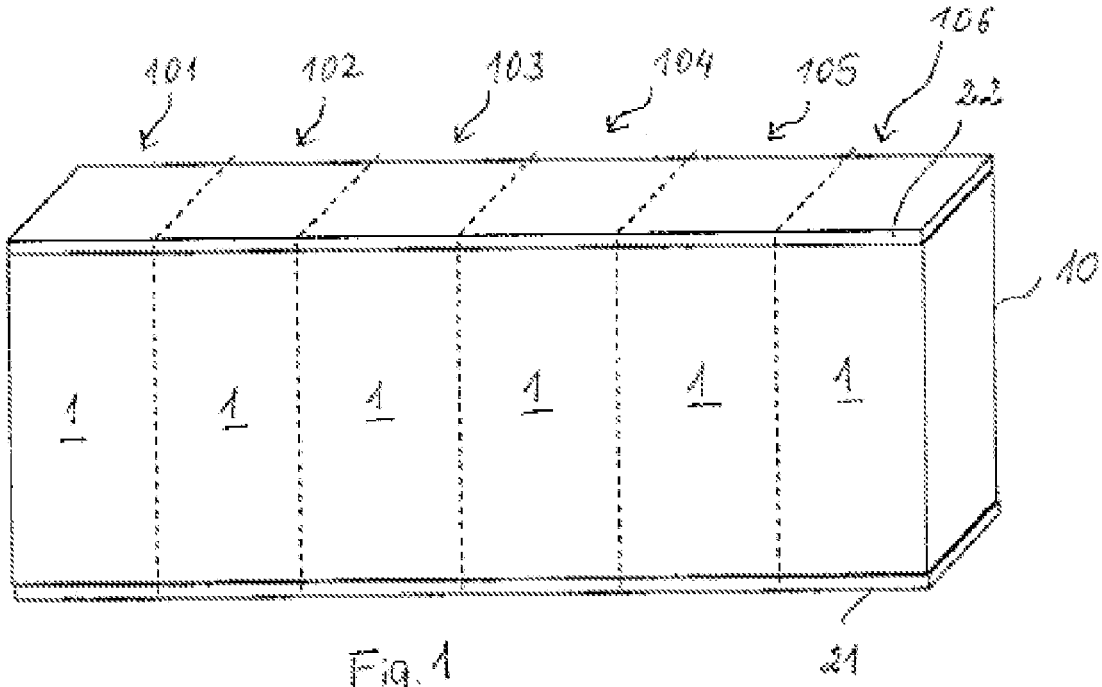
FIG. 1, a large area substrate with the deposited barrier layer and component regions which have not yet been partitioned, FIG. 2, a partitioned component region, FIG. 3, the partitioned component region with rounded edges before the dipping process, FIG. 4, the partitioned component region after the dipping process, and FIG. 5, a completed component.

FIG. 1 shows a large area substrate 10 with a barrier layer 21, 22 deposited on its two primary surfaces. The substrate 10 has not-yet-partitioned component regions 101-106. Cutting lines, i.e., boundaries between different component regions, are indicated with dashed lines.

Each component region comprises a base body 1 and barrier layers 21, 22 arranged on its end faces.

In FIG. 1, the large area substrate 10 is constructed as a bar that is cut perpendicular to its longitudinal direction. The large area substrate 10, however, can also have component regions arranged as a two-dimensional matrix. Here, cutting is performed in directions extending perpendicular to each other.

Figure 2:
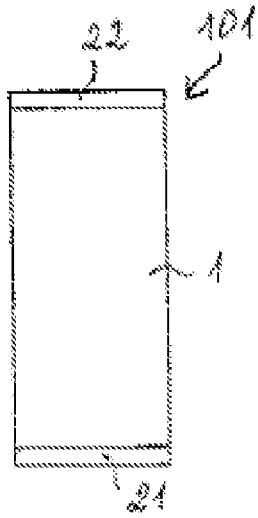
Figure 3:
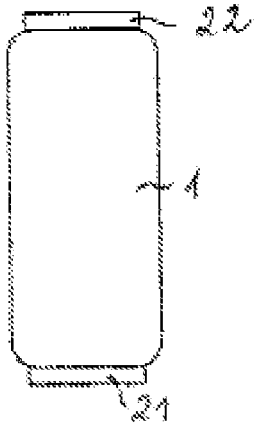
Figure 4:
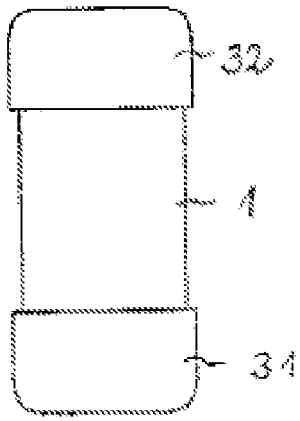

In FIGS. 2 and 3, a partitioned component region 101 is shown before and after the abrasion, respectively. The dipped component region with silver-containing caps 31, 32 is shown in FIG. 4. These caps cover the end faces of this component region, overlapping the edges. Edge regions of the side surfaces of the base body facing the end face are covered by the caps 31, 32.

Figure 5:
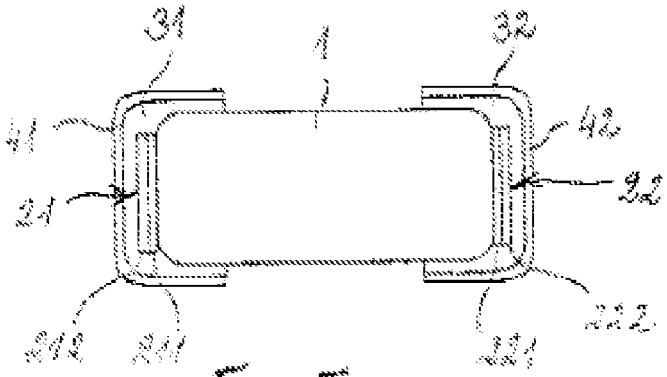

A completed component after the tin plating of caps 31, 32 is shown in FIG. 5. The barrier layer 21, 22 has a lower sub-layer 211, 221 (e.g., Cr layer) deposited and reinforced, optionally galvanically, through sputtering, optionally a chemically deposited middle sub-layer (e.g., Ni layer), not shown in the figure, and a galvanically deposited upper sub-layer 212, 222 (e.g., Ni layer).

A tin-containing layer 41, 42 that can be soldered is arranged on the silver-containing cap 31, 32 that can be generated through dipping. The regions of the caps 31, 32 facing downward form component contacts (SMD contacts) that are suitable for surface mounting.

The specified component and method as well as the number and material of sub-layers are not limited to the constructions shown in the figures, and especially the shown form of the base body. All of the layers deposited by sputtering can also be generated in a dipping process or a screen-printing method with subsequent burn-in.

What is claimed is:

1. An electrical PTC thermistor component comprising:

a base comprising a surface and first and second faces on different sides of the base;

first and second conductive layers, each of the first and second conductive layers being on at least one of the first and second faces;

wherein the first conductive layer is not on the surface;

wherein the first conductive layer comprises a sub-layer comprising chromium; and wherein the second conductive layer comprises a cap that covers, and overlaps edges of, the at least one of the first and second faces.

2. The component of claim 1, wherein the base body comprises a ceramic material; and wherein the first conductive layer is comprises a barrier layer for breaking down a depletion layer of the component.

3. The component of claim 1; wherein the second conductive layer comprises a surface that is solderable.

4. The component of claim 1, wherein the component is configured for surface mounting.

5. The component of claim 1, wherein the first conductive layer comprises a sputtered sub-layer and a galvanically deposited sub-layer.

6. The component of claim 1, wherein the second conductive layer comprises at least one dipping-deposited layer.

7. The component of claim 1, wherein edges between the first and second faces and the surface of the base are beveled or rounded.

8. A method for producing a PTC thermistor component, comprising:

generating a barrier layer that is conductive by sputtering the barrier layer on primary surfaces of a substrate comprising PTC ceramic and comprising component regions;

partitioning the substrate into the component regions, wherein a partitioned component region comprises a base, and wherein the barrier layer is on end faces of the base; and adding conductive caps to the end faces, wherein the conductive caps are added via a dipping process and a burning-in process.

9. The method of claim 8, further comprising reinforcing the barrier layer galvanically.

10. The method of claim 8, further comprising plating the conductive caps with tin after the dipping process.

11. The method of claim 8, further comprising rounding, via abrasion, edges between the end faces and a surface of the base.

12. The method of claim 9 further comprising plating the conductive caps with tin after the dipping process.

13. The method of claim 11 further comprising plating the conductive caps with tin after the dipping process.

14. The method of claim 9, further comprising rounding, via abrasion, edges between the end faces and a surface of the base.

15. The component of claim 2, wherein the second conductive layer comprises a surface that is solderable.

16. The component of claim 15, wherein the component is configured for surface mounting.

17. The component of claim 16, wherein the first conductive layer comprises a sputtered sub-layer and a galvanically deposited sub-layer.

18. The component of claim 17, wherein the second conductive layer comprises at least one dipping-deposited layer.

19. The component of claim 18, wherein edges between the first and second faces and the surface of the base are beveled or rounded.

20. The component of claim 1, wherein each of the first and second conductive layers is on each of the first and second faces; and wherein each second conductive layer comprises a cap that covers, and overlaps edges of, a corresponding one of the first and second faces.

21. An electrical PTC thermistor component comprising:

a base comprising a surface and first and second faces on different sides of the base;

first and second conductive layers, each of the first and second conductive layers being on at least one of the first and second faces;

wherein the first conductive layer comprises a first sub-layer comprising chromium, the first sub-layer having a thickness of 0.1 μm to 1.0 μm;

wherein the first conductive layer comprises a second sub-layer comprising nickel, the second sub-layer having a thickness greater than 1.0 μm; and wherein the second conductive layer comprises a cap that covers, and overlaps edges of, the at least one of the first and second faces.

22. An electrical PTC thermistor component comprising:

a base comprising a surface and first and second faces on different sides of the base;

first and second conductive layers, each of the first and second conductive layers being on at least one of the first and second faces;

wherein the first conductive layer is not on the surface;

wherein the second conductive layer comprises a cap that covers, and overlaps edges of, the at least one of the first and second faces; and wherein the second conductive layer comprises at least one dipping-deposited layer.

23. An electrical PTC thermistor component comprising:

a base comprising a surface and first and second faces on different sides of the base;

first and second conductive layers, each of the first and second conductive layers being on at least one of the first and second faces;

wherein the first conductive layer is not on the surface, the first conductive layer comprising a sputtered sub-layer and a galvanically deposited sub-layer; and wherein the second conductive layer comprises a cap that covers, and overlaps edges of, the at least one of the first and second faces.

* * * * *

UNITED STATES PATENT AND TRADEMARK OFFICE

CERTIFICATE OF CORRECTION

PATENT NO. : 8,154,379 B2
APPLICATION NO. : 12/297579
DATED : April 10, 2012
INVENTOR(S) : Udo Theissl and Andreas Webhofer It is certified that error appears in the above-identified patent and that said Letters Patent is hereby corrected as shown below:

Column 3, Claim 2, Line 63;
After "layer" Delete "is"

Signed and Sealed this
Twenty-eighth Day of August, 2012

David J. Kappos

David J. Kappos
*Director of the United States Patent and Trademark Office*